US011013983B1

(12) United States Patent
Kamat

(10) Patent No.: US 11,013,983 B1
(45) Date of Patent: May 25, 2021

(54) DYNAMIC MEMORY GAME

(71) Applicant: Rajaram Dattatray Kamat, Woodstock, GA (US)

(72) Inventor: Rajaram Dattatray Kamat, Woodstock, GA (US)

( * ) Notice: Subject to any disclaimer, the term of this patent is extended or adjusted under 35 U.S.C. 154(b) by 0 days.

(21) Appl. No.: 16/810,490

(22) Filed: Mar. 5, 2020

(51) Int. Cl.

| | |
|---|---|
| ***A63F 1/02*** | (2006.01) |
| ***A63F 9/00*** | (2006.01) |
| *A63F 3/00* | (2006.01) |
| *A63F 11/00* | (2006.01) |

(52) U.S. Cl.
CPC ..... *A63F 9/001* (2013.01); *A63F 1/02* (2013.01); *A63F 2003/00943* (2013.01); *A63F 2009/0012* (2013.01); *A63F 2011/0079* (2013.01); *A63F 2011/0083* (2013.01); *A63F 2011/0086* (2013.01)

(58) Field of Classification Search
CPC ..... A63F 2011/0083; A63F 2011/0079; A63F 2011/0086; A63F 1/02; A63F 2003/00943
USPC ..... 273/273, 148 R, 148 A, 153 R, 241
See application file for complete search history.

(56) References Cited

U.S. PATENT DOCUMENTS

| | | | | | |
|---|---|---|---|---|---|
| 3,999,327 | A * | 12/1976 | Immordino | A63H 33/04 | 446/73 |
| 5,964,350 | A * | 10/1999 | LaMarche | B65D 21/0202 | 206/470 |
| 6,698,760 | B2 * | 3/2004 | Francise | G09B 19/0046 | 273/273 |
| 8,876,113 | B2 * | 11/2014 | Dolk | A63F 3/02 | 273/260 |
| 2003/0159319 | A1 * | 8/2003 | Ransom | A47F 3/14 | 40/306 |
| 2003/0234200 | A1 * | 12/2003 | Diamant | B65D 21/0202 | 206/508 |
| 2005/0230915 | A1 * | 10/2005 | Alvarez | A63F 3/00697 | 273/288 |

* cited by examiner

*Primary Examiner* — Benjamin Layno

(57) ABSTRACT

This memory game is made more exciting and challenging by using plurality of matching pairs of cards or 3-D objects inside stack-able boxes with lids. Boxes are arranged in plurality of stacks. Open lids of two boxes to find a match. Except for top box in a stack, to open a box: lift boxes on top of it and place them on top of another stack first. This process relocates boxes dynamically during play. After collecting matching objects from two open boxes: this game provides options to keep none, some, or all empty boxes in play. Empty boxes left in play also get relocated during play adding more challenge.

3 Claims, 15 Drawing Sheets

DYNAMIC MEMORY GAME

CROSS-REFERENCE TO RELATED APPLICATIONS

This application claims priority under 35 U.S.C. § 119(e) to U.S. Provisional Patent Application listed above. The complete disclosure of that application is hereby incorporated by reference for all purposes.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

This invention is in the field of games designed to help memory development or memory exercise.

Deficiency 1 in memory games available today: They are static: the memory objects (cards or 3-D pieces) are arranged at the beginning of the game. They stay at the same physical location until the end of the game. Even if the objects move during play, they remain in the same relative position compared to other objects.

This invention is makes objects dynamically relocate during play: physically and relative to other objects. This makes the game exciting and challenging.

Deficiency 2 in memory games available today: They are not designed to include empty boxes in play where the empty boxes also dynamically relocate during play.

This invention supports this feature and makes the game even more challenging.

Deficiency 3 in memory games available today: They are not designed to play at a wide range of levels of difficulty, starting at 6 year old to teens to adults to chess grand masters.

This invention supports this feature and makes the investment in the game worthwhile: a child can use it for years and share it with older children or adults in the family.

BRIEF SUMMARY OF THE INVENTION

The object of the invention is to create an enhanced memory game that adds challenge and can be played at multiple levels of difficulty while keeping the basics same, i.e. finding a matching pair of cards or objects.

The setup: The game consists of plurality of stack-able boxes with lids. Matching pairs of memory objects are placed inside the boxes. The boxes are randomly placed in plurality of stacks. Single player can play solo to exercise memory, more than two players can play the game but typically two players play the game.

The play: Player removes the lid of any box at the top of any stack to look at the object. To look at object inside any other box, the player lifts all boxes above that box and places them on top of another stack first. Player exposes two objects at a time. If a match is found: collects objects and boxes or collects only objects and replaces lids on empty boxes.

Fixing deficiency 1: Lifting boxes and placing them on top of another stack relocates objects during play.

Fixing deficiency 2: If empty boxes are left in play, they also get relocated during play.

Fixing deficiency 3: This game can be played at multiple levels of difficulty by including none, some, or all empty boxes in play.

The diagrams and detailed description fully explain these features and how to play at different levels of difficulty.

BRIEF DESCRIPTION OF THE SEVERAL VIEWS OF THE DRAWINGS

FIG. 2, FIG. 3, FIG. 4 shows that the top boxes 6, 12, 18 can be opened without re-stacking any box

FIG. 11, FIG. 12, FIG. 13 shows the status of boxes if: while opening first box, the player had re-stacked 5 and 6 on top of 18 and while opening second box, re-stacked 12 on top 6. Stacks in FIG. 8, FIG. 9, FIG. 10 and FIG. 11, FIG. 12, FIG. 13 look different based on player choices; both players need to observe carefully.

In FIG. 14, FIG. 16, box 3 and open box 4 above are lifted and placed on top of 18; and then box 2 is opened

Flat memory cards are placed face down at the bottom of each box. Boxes are placed in 3 stacks and the game is played the same way as the game with lids

DETAILED DESCRIPTION OF THE INVENTION

The game uses plurality of stack-able boxes with lids arranged in plurality of stacks. Plurality of matching pairs of 3-D objects or picture cards are placed inside the boxes. To simplify the drawings and game description, a configuration of 18 boxes with lids holding 9 pairs of 3-D objects arranged in 3 stacks with 6 boxes in each stack is used.

Figure 1:
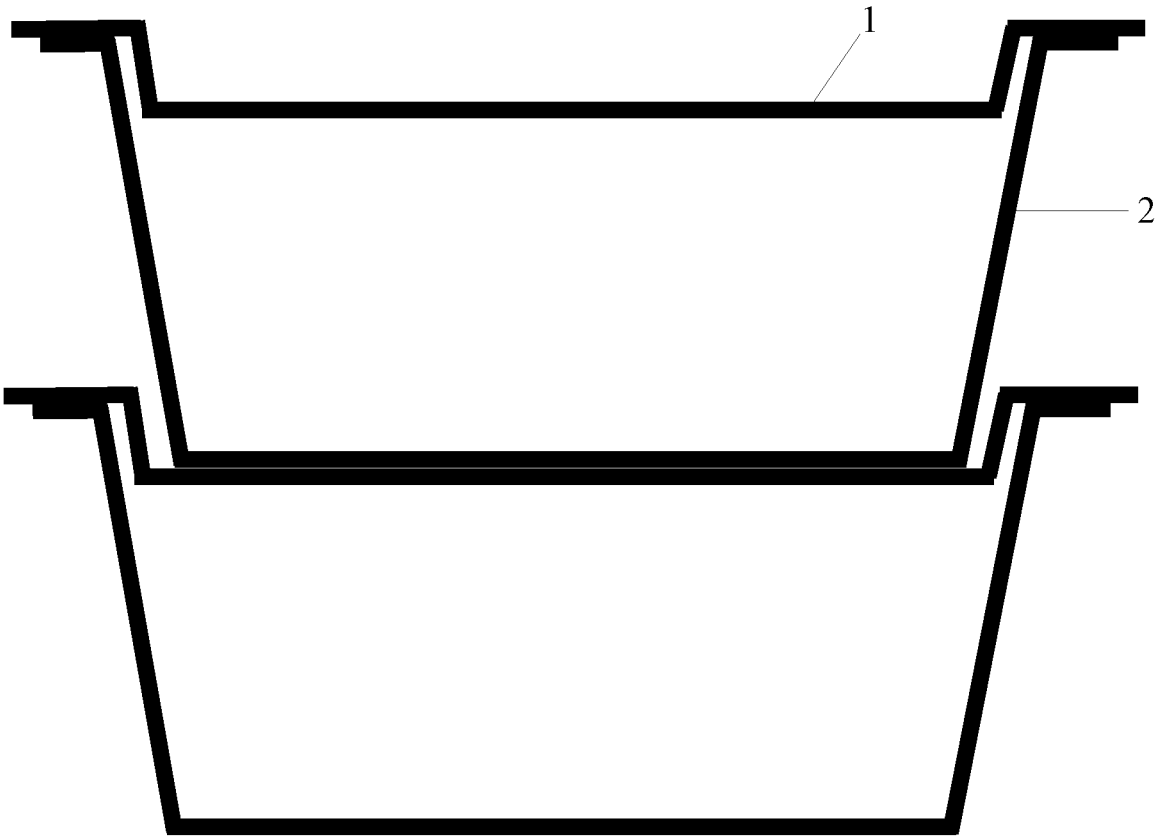
FIG. 1: Shows the lid (1) and box (2) shapes to illustrate the stable and stack-able features of boxes and lids.

Game construction: Make 18 stack-able boxes with lids. Boxes should have wide base for stability and lids should have indents for stable stacking. FIG. 1 shows the lid (1) and box (2) shapes. Make 9 pairs of 3-D objects that fit inside the boxes.

Figures 2, 3, 4:
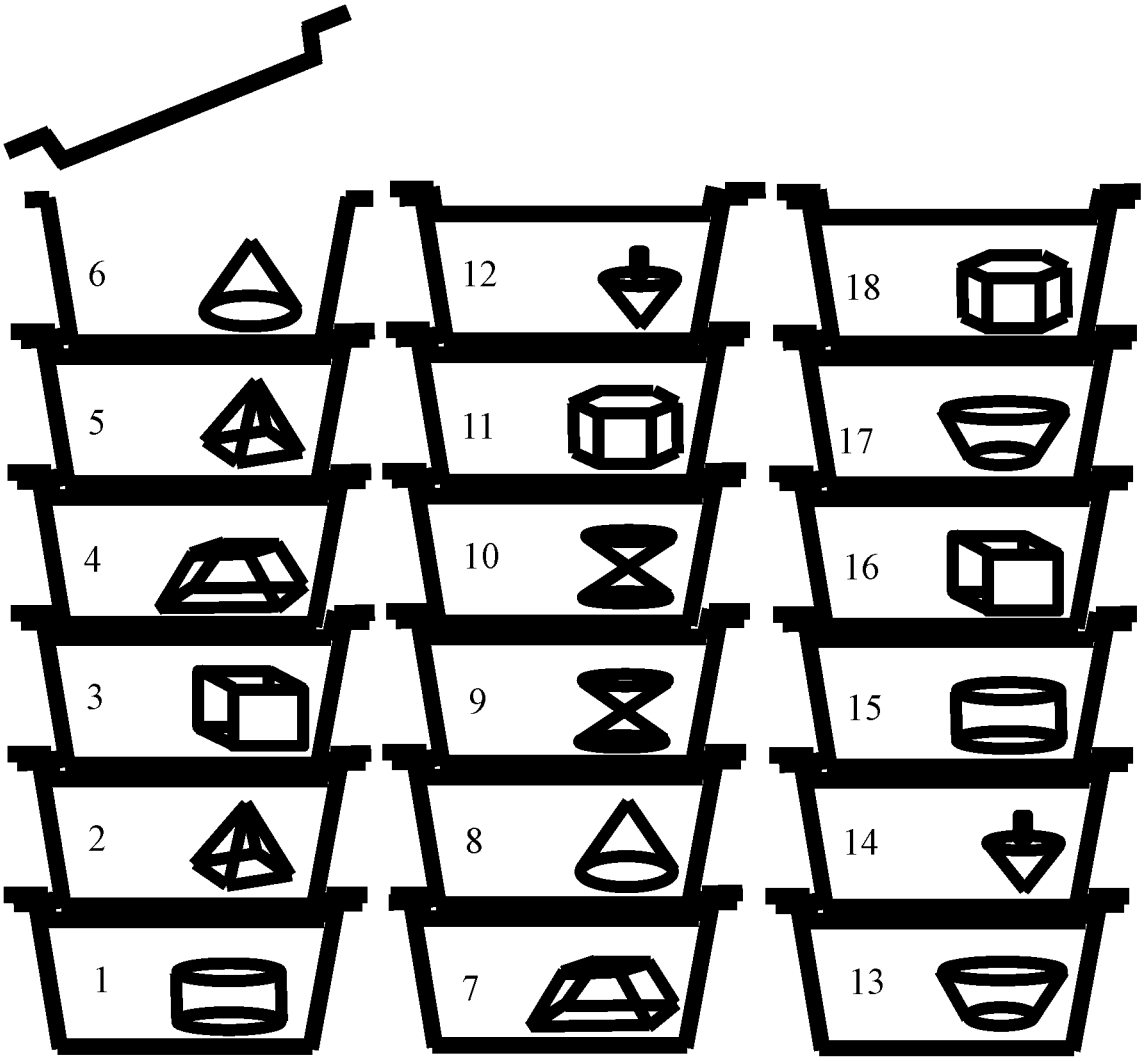
FIG. 2, FIG. 3, FIG. 4: Shows the initial setup with a sample configuration with 3 stacks, 6 boxes per stack. The boxes are numbered 1 to 18 to help explain the game process. The boxes in real game are not numbered. The 3-D objects inside the closed boxes are visible in the drawings to explain the game. The 3-D objects inside the closed boxes will not be visible in real game.

Game setup: FIG. 2, FIG. 3, FIG. 4 shows how the 18 boxes with objects inside are setup in 3 stacks with 6 boxes in each stack. The boxes are numbered 1 through 18 to help explain the game process and illustrate the features.

How to play: Two players take turns to open two boxes at a time to find matching objects.

How to open first box: In FIG. 2, FIG. 3, FIG. 4, box number 6, 12 and 18 are at the top of the 3 stacks and the lid can be opened to expose the object inside. In FIG. 2, the lid of box 6 illustrates lifting of the lid to open the box.

Figures 5, 6, 7:
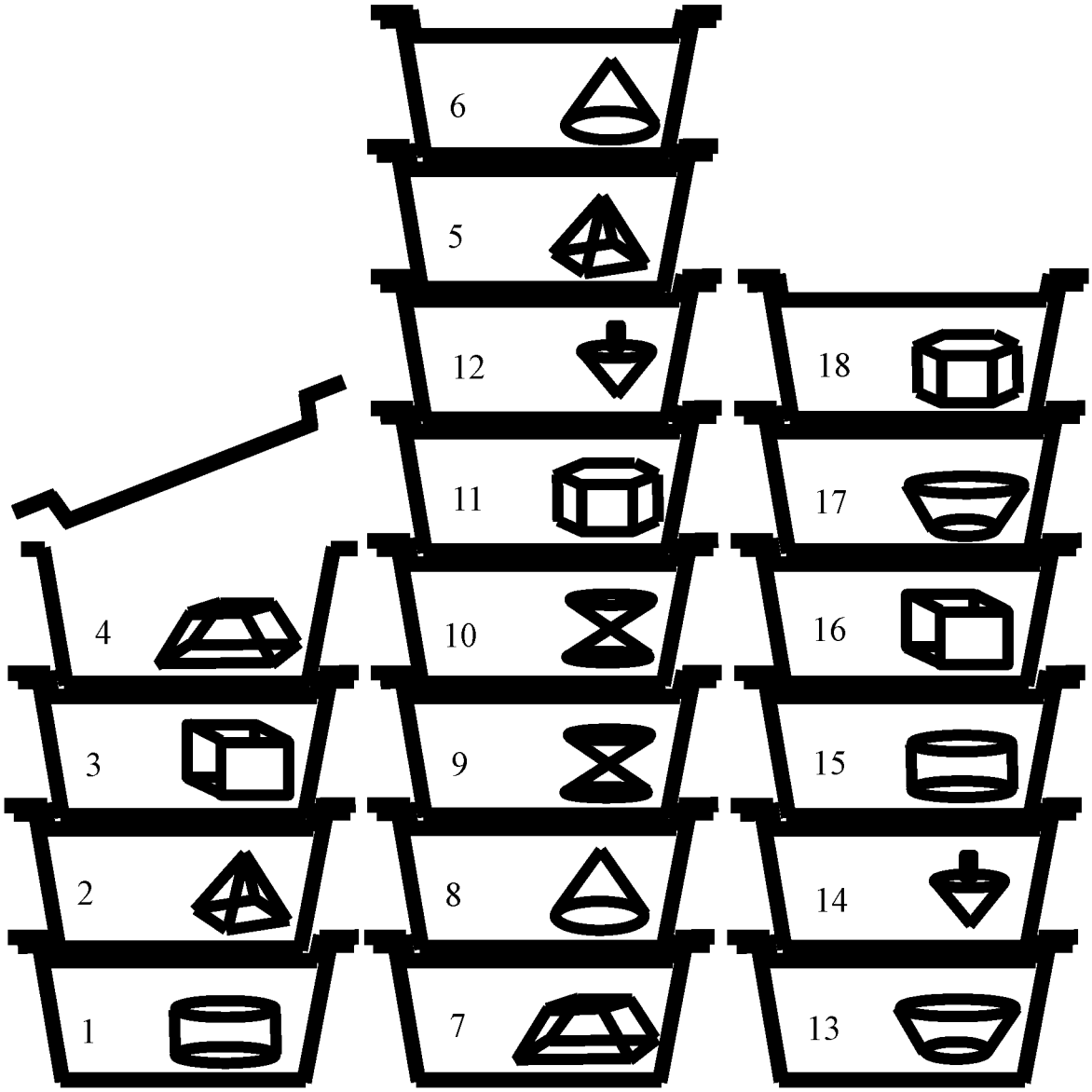
FIG. 5, FIG. 6, FIG. 7: Shows the process of opening the first box. To open box 4: box 5 is lifted and re-stacked on top of box 12; player could re-stack 5 on top of 18. The boxes are re-stacked as a group, that is, box 5 is lifted and placed on 12 and 6 moves with it. Re-stack is not one box at a time, placing 6 on top of 12 and then placing 5 on top of 6.

How to open first box, continued: In FIG. 2, FIG. 3, FIG. 4, boxes 1 to 5, 7 to 11, and 13 to 17 have other boxes on top and the lid cannot be lifted. To open one of these boxes, the box above is lifted and placed on top of another stack. To open box 4: box 5 is lifted and placed on top of box 12 as shown in FIG. 5, FIG. 6. Placing box 5 on top of 18 instead of 12 is an option and can be seen in a later FIG. 13. Note that all boxes above box 5 get moved with box 5. In FIG. 6, box 6 moved to middle stack.

Figure 8:
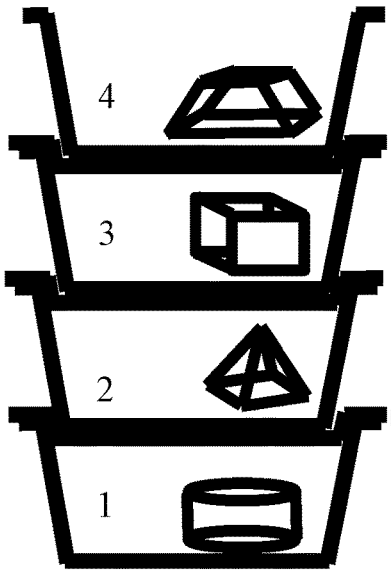
FIG. 8, FIG. 9, FIG. 10: Shows process of opening second box, example 1. To open box 11: lift box 12 and place on top of box 18; boxes 5 and 6 move as they are on top of 12; stacking 12 on top of open box 4 is not an option. Note that boxes 5 and 6 have changed location twice.
Figure 9:
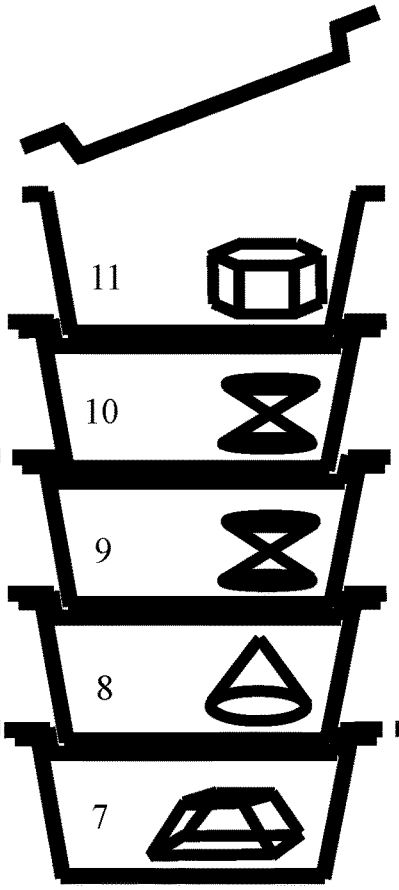
Figure 10:
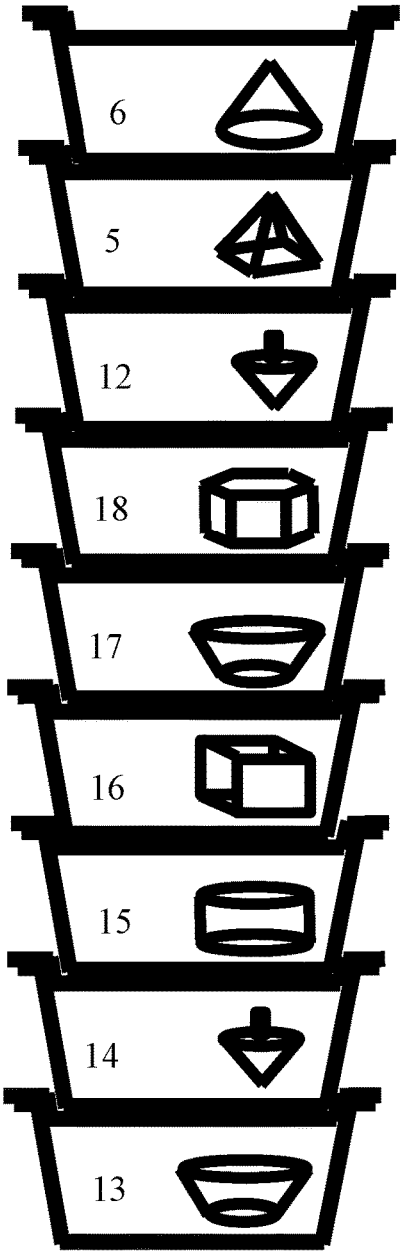

Opening second box, example 1: Player decides to open box 11. Player lifts box 12 and places it on top of box 18. Note that placing it on top of open box 4 is not an option. Boxes 5 and 6 were on top of 12 and move with it. FIG. 8, FIG. 9, FIG. 10 shows the locations of boxes after second box 11 is opened.

Figures 11, 12, 13:
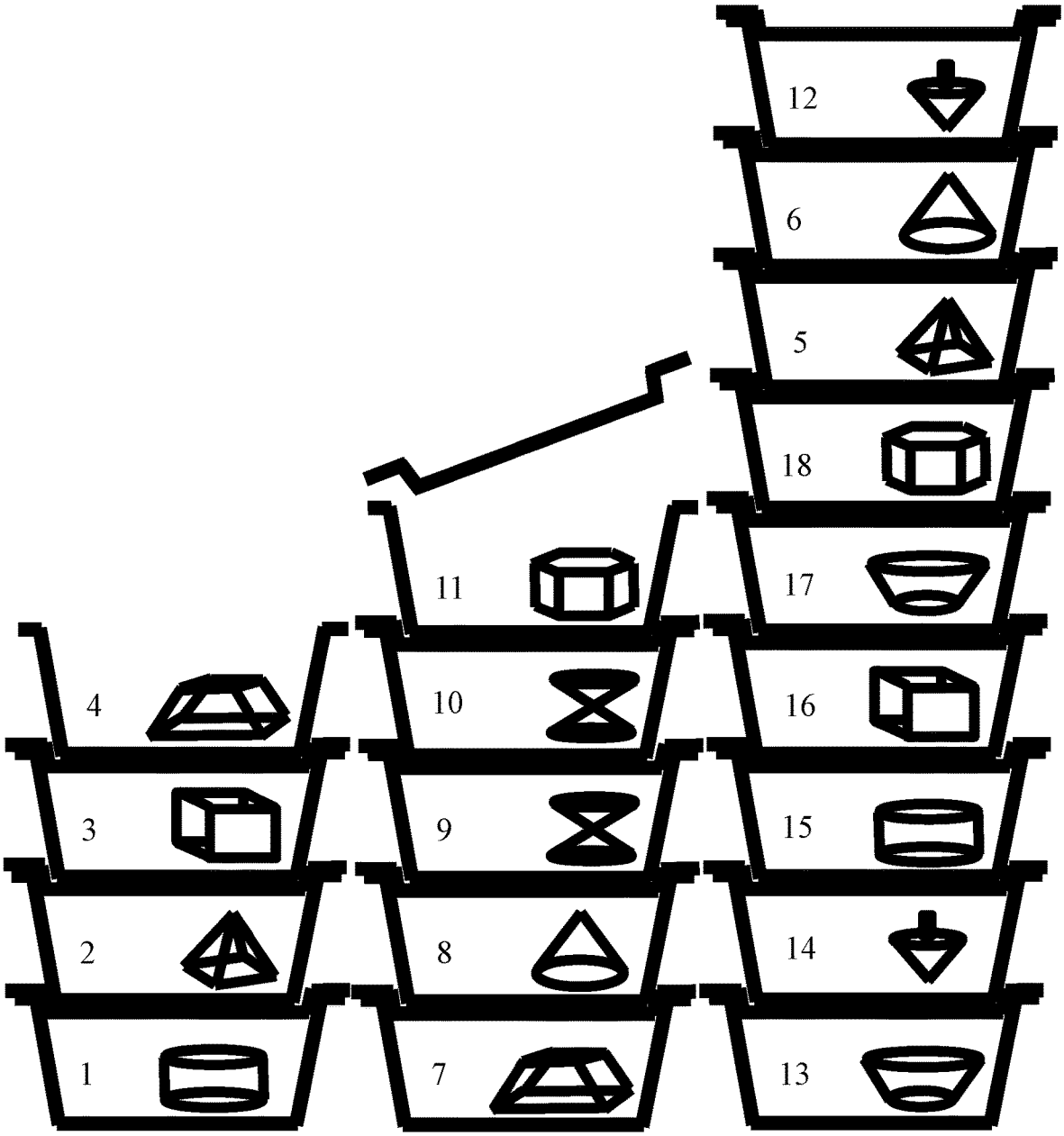
FIG. 11, FIG. 12, FIG. 13: Shows process of opening second box, example 2.

Opening second box, example 2: FIG. 11, FIG. 12, FIG. 13 shows the location of boxes if box 5 was placed on top of box 18 while opening the first box. To open box 11, box 12 is lifted and placed on top of 6. This illustrates dynamic movement of boxes based on choices made by players.

Figure 14:
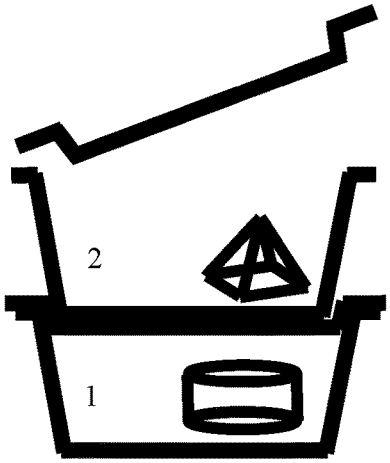
FIG. 14, FIG. 15, FIG. 16: Shows process of opening second box, example 3. Open box can be shifted to another stack to reveal a box below.
Figure 15:
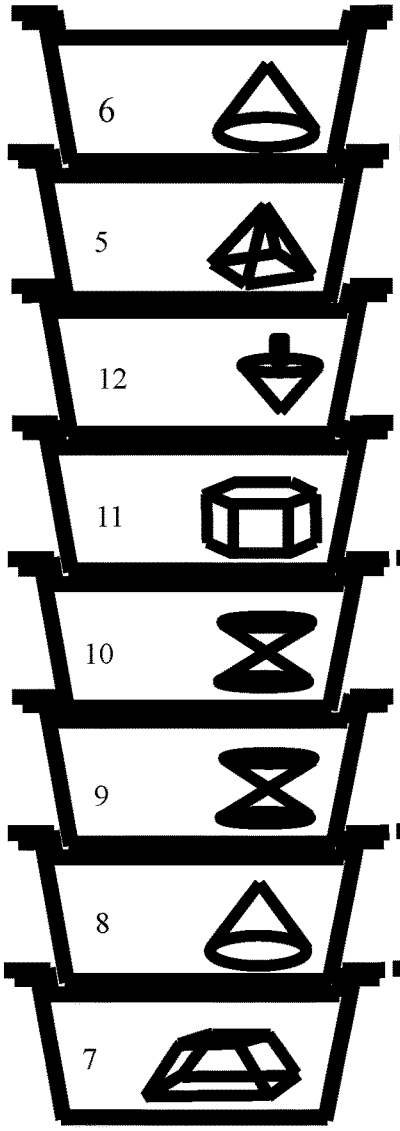
Figure 16:
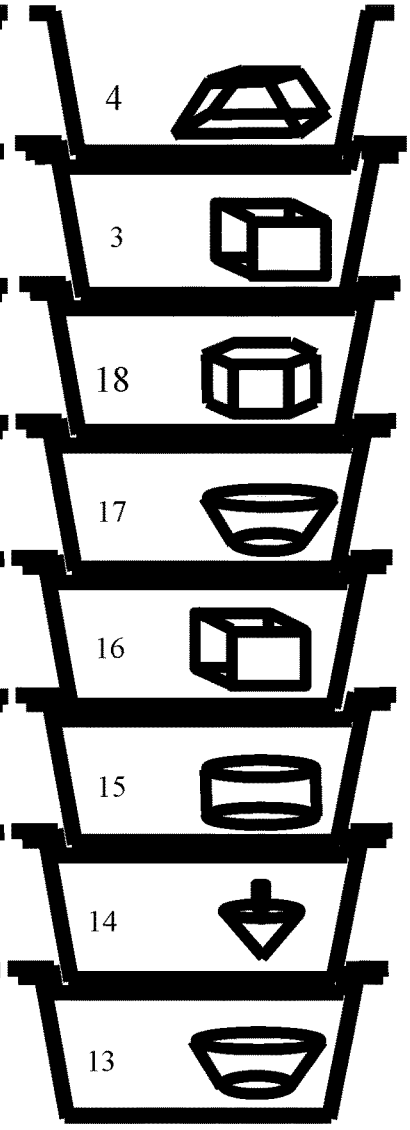

Opening second box, example 3: FIG. 14, FIG. 15, FIG. 16 shows that an open box or a box below the open box can be lifted and placed on another stack. Instead of opening box 11 as the second box, the player chooses to open box 2. Box 3 is lifted and placed on top of 18. Box 4 moves with box 3.

After opening two boxes if a match is found, the objects are collected and the two boxes are removed from the stacks. The player continues to open two more boxes until no match is found. When no match is found, both boxes are closed and the other player takes turn.

Game ends when all objects have been found. The player with most objects is the winner.

This game can be played at different levels of difficulty. Three levels of difficulty are illustrated in FIG. 17 through FIG. 33. Details follow.

Figure 17:
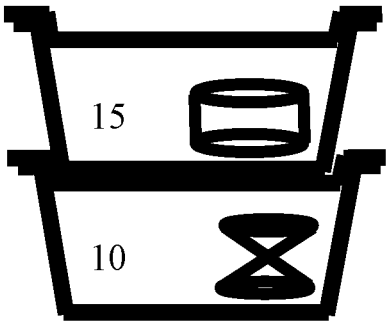
FIG. 17, FIG. 18, FIG. 19: Shows what the stack may look like at halfway point in the game where the player collects the objects and the boxes when a match is found. 8 matching objects have been removed and 8 boxes also have been removed. Due to re-stacking, 10 remaining boxes have been moved around.
Figure 18:
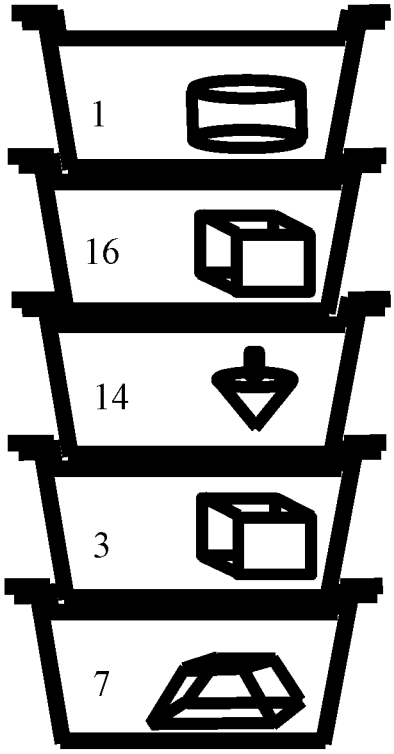
Figure 19:
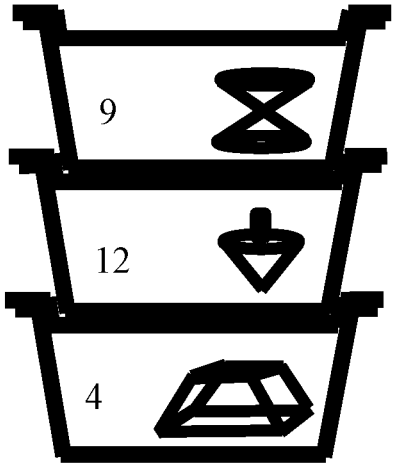
Figure 26:
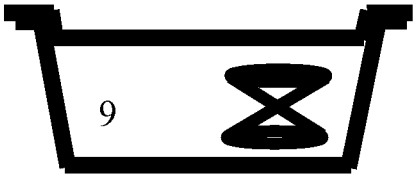
FIG. 26, FIG. 27: Shows what the stack may look like towards the end of the game with no empty boxes in play stack. 14 matching objects have been removed. 14 boxes also have been removed. Due to re-stacking, 4 remaining boxes have been moved around, With only 4 boxes in play, the end game is very easy.
Figure 27:
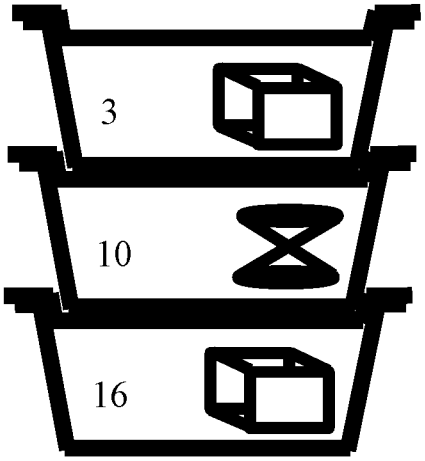

Difficulty level 1: When a match is found, objects and boxes are removed. FIG. 17, FIG. 18, FIG. 19 shows a snapshot halfway through the game. FIG. 26, FIG. 27 shows a snapshot towards the end of the game. Dynamic movement of boxes does make this game more difficult than static memory games but reduced number of boxes in play makes the game easier as it progresses.

Figures 20, 21, 22:
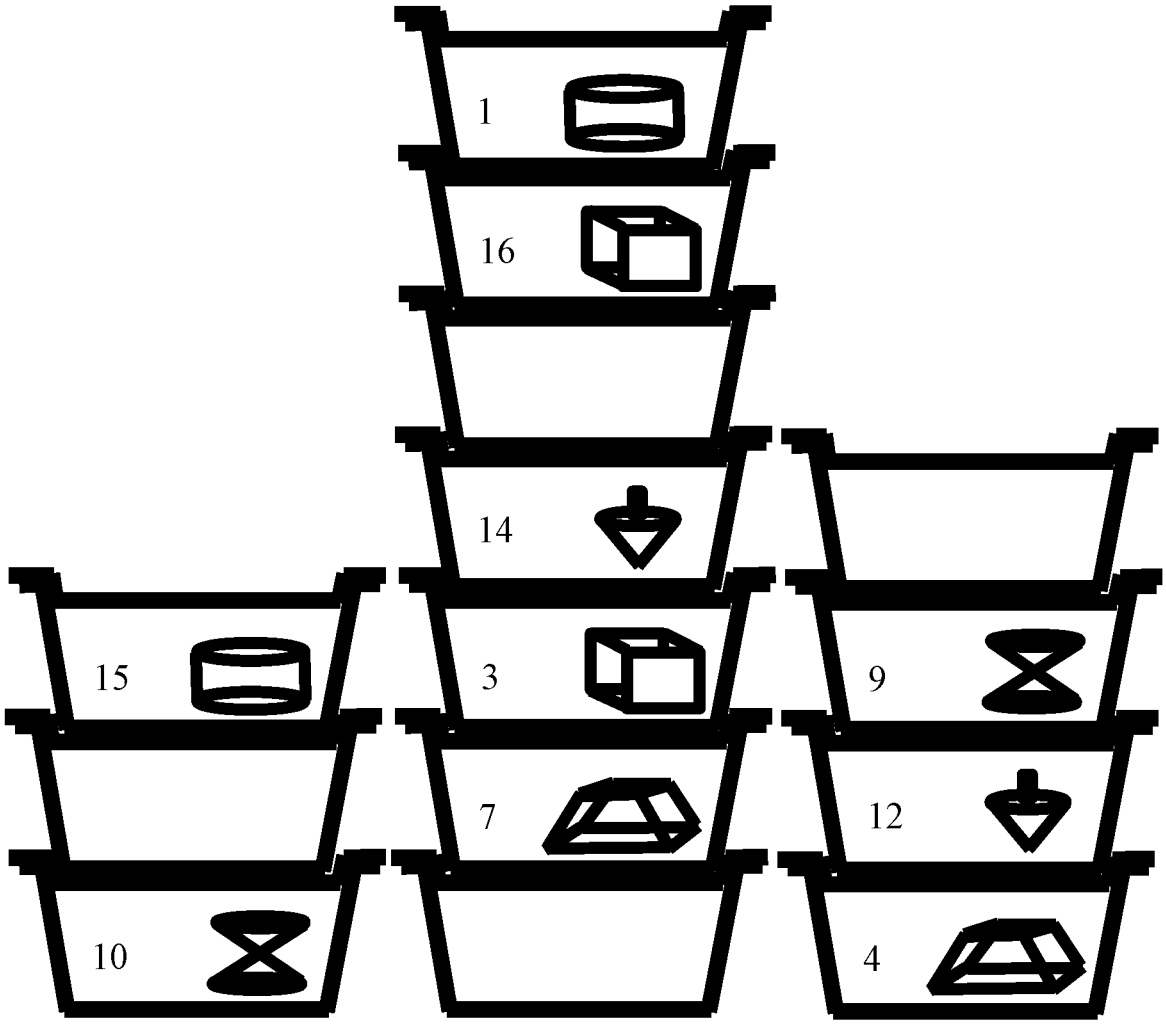
FIG. 20, FIG. 21, FIG. 22: Shows adding a level of complexity. It shows what the stack may look like at halfway point in the game where 4 empty boxes are left in play stack, i.e. when the first two matches are found, the objects are collected but the boxes are closed and left in play. 8 matching objects have been removed. First 4 empty boxes have been left in play but the next 4 empty boxes have been removed. 10 remaining boxes with objects and 4 empty boxes have been moved around. Empty boxes are not numbered in FIG. 20, FIG. 21, FIG. 22. Finding matching objects while avoiding empty boxes adds a level of complexity.
Figure 28:
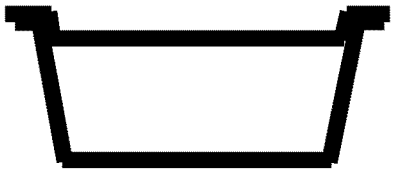
FIG. 28, FIG. 29, FIG. 30: Shows what the stack may look like towards the end of the game with 4 empty boxes in play stack. 14 matching objects have been removed. First four empty boxes have been left in play and next 10 empty boxes have been removed. 4 remaining boxes with objects and 4 empty boxes have been moved around. Empty boxes are not numbered in FIG. 28, FIG. 29, FIG. 30. Having 4 empty boxes in the stack makes finding the last 4 objects a little more difficult.
Figure 29:
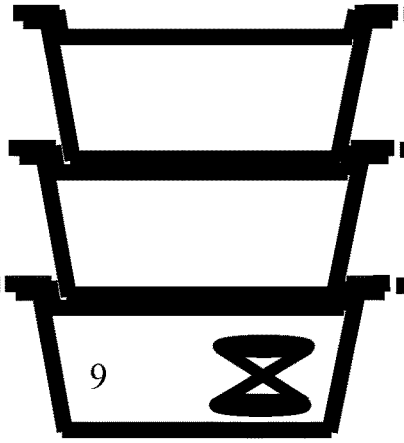
Figure 30:
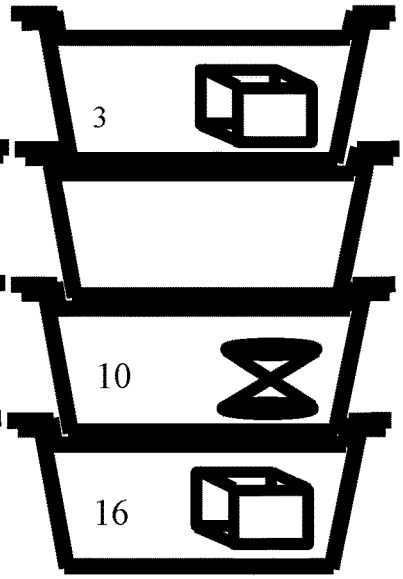

Difficulty level 2: For the first two matches, the objects are collected but the empty boxes are left in play. Empty boxes are removed for rest of the game. FIG. 20, FIG. 21, FIG. 22 shows a snapshot halfway through the game. FIG. 28, FIG. 29, FIG. 30 shows a snapshot towards the end of the game. The player has to remember where the 4 empty boxes are. Opening one or two empty boxes results in no matching objects and player loses a turn. The difficulty level is elevated throughout the game.

Figures 23, 24, 25:
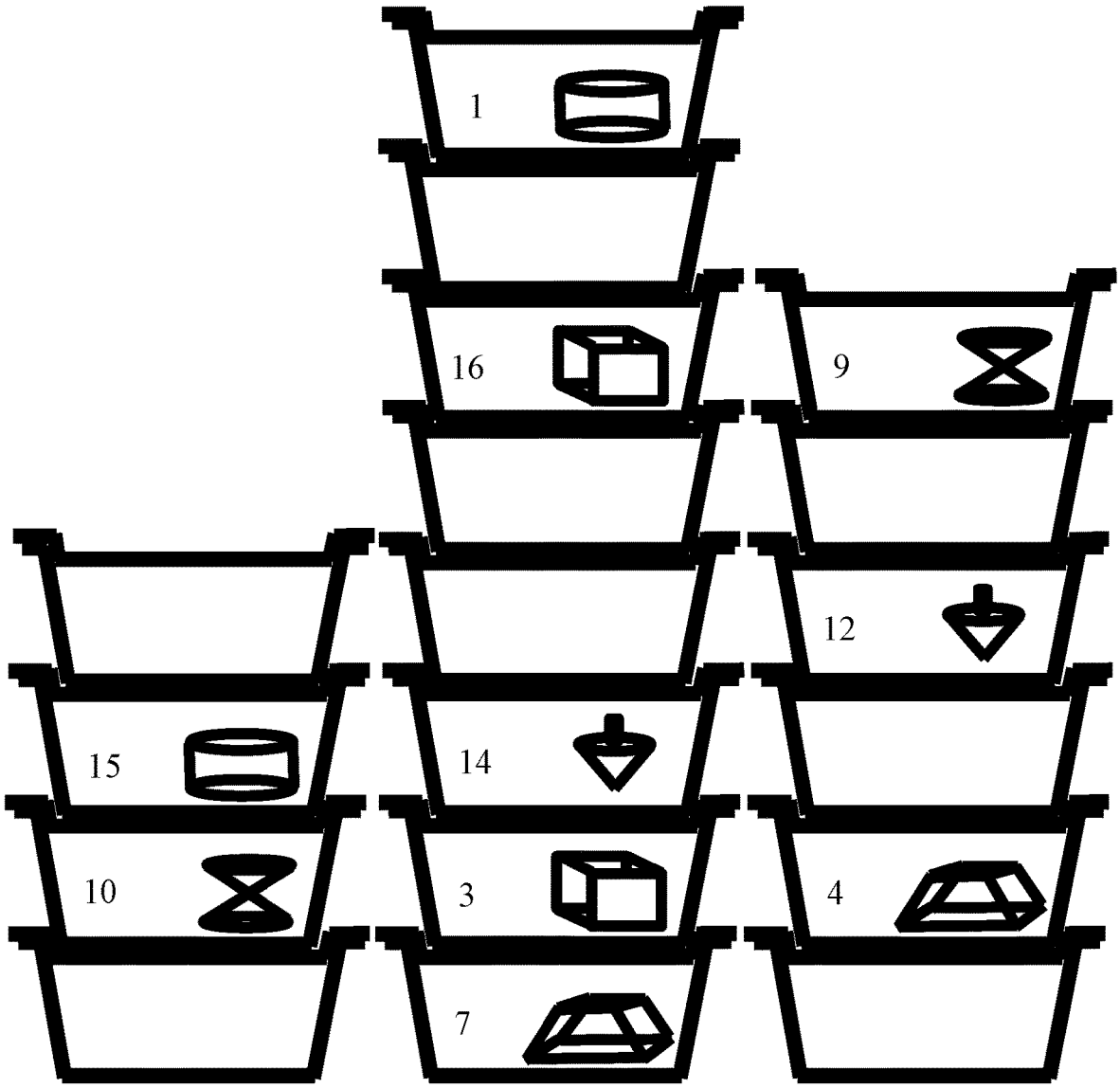
FIG. 23, FIG. 24, FIG. 25: Shows adding a higher level of complexity. It shows what the stack may look like at halfway point in the game where all empty boxes are left in play stack. 8 matching objects have been removed. All 8 empty boxes have been left in play. 10 remaining boxes with objects and 8 empty boxes have been moved around. Empty boxes are not numbered in FIG. 23, FIG. 24, FIG. 25. Finding matching objects while avoiding large number of empty boxes adds a higher level of complexity.
Figure 31:
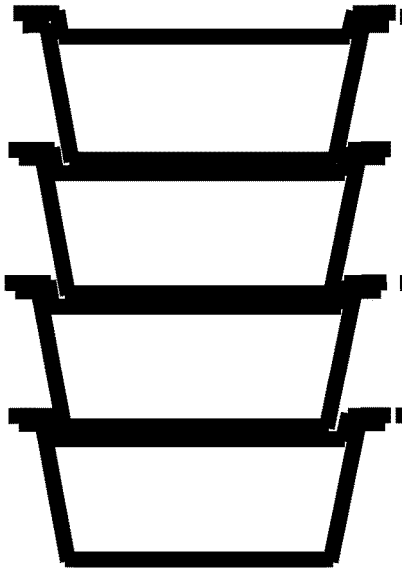
FIG. 31, FIG. 32, FIG. 33: Shows what the stack may look like towards the end of the game with all empty boxes in play stack. 14 matching objects have been removed. All 14 empty boxes have been left in play. 4 remaining boxes with objects and 14 empty boxes have been moved around. Empty boxes are not numbered in FIG. 31, FIG. 32, FIG. 33. Having 14 empty boxes in the stack makes finding the last 4 objects a lot more difficult.
Figure 32:
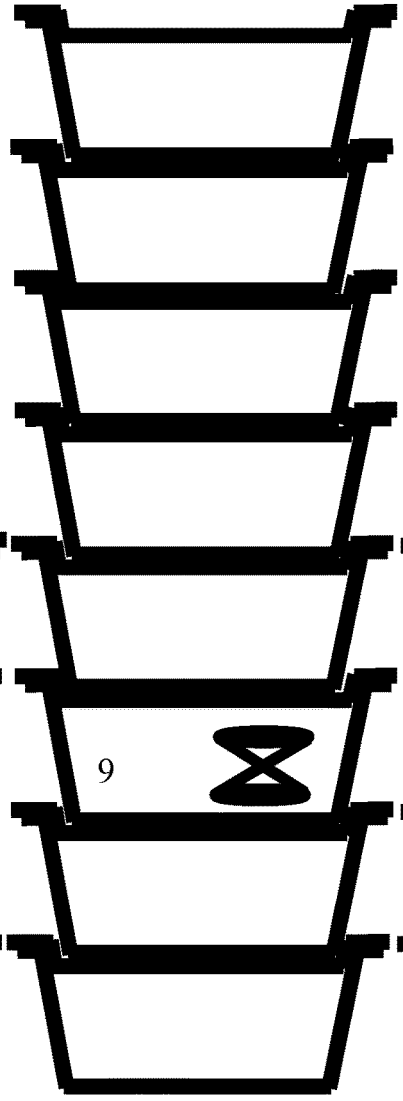
Figure 33:
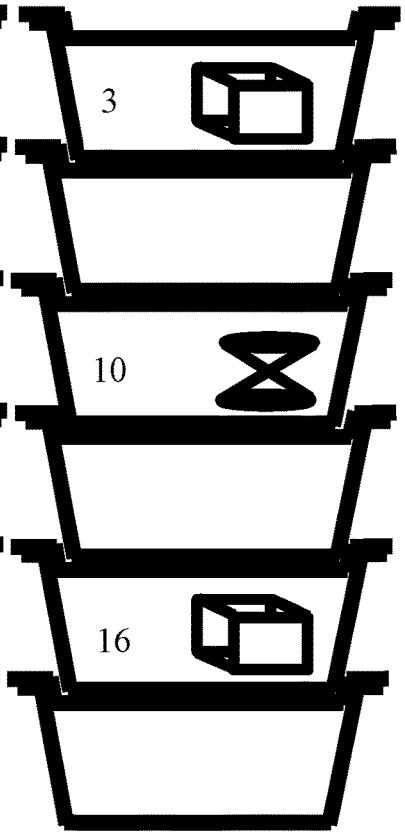
Figure 34:
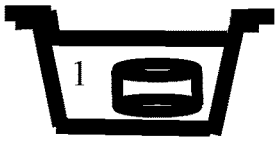
FIG. 34 through FIG. 51: Shows a setup where each stack has one box. 18 boxes are placed in rows on a flat surface. All boxes are top boxes. No lifting or relocation of boxes is necessary to open any box.
Figure 35:
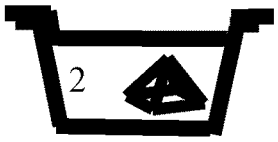
Figure 36:
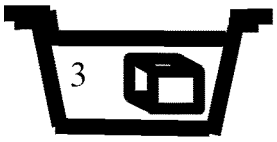
Figure 37:
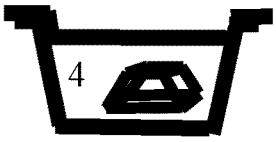
Figure 38:
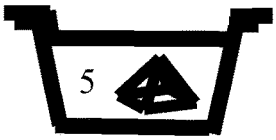
Figure 39:
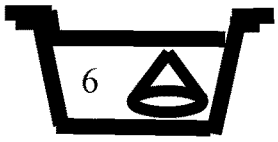
Figure 40:
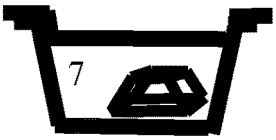
Figure 41:
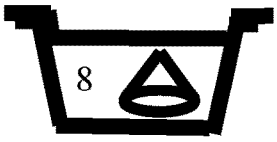
Figure 42:
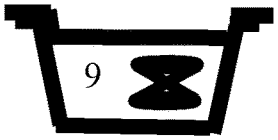
Figure 43:
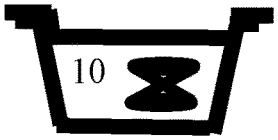
Figure 44:
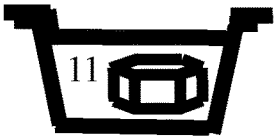
Figure 45:
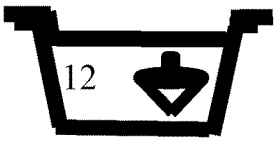
Figure 46:
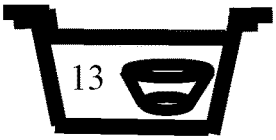
Figure 47:
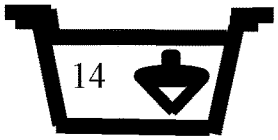
Figure 48:
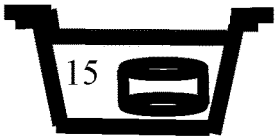
Figure 49:
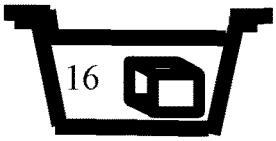
Figure 50:
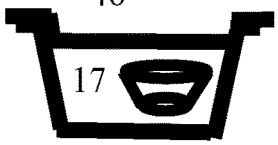
Figure 51:
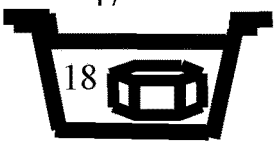

Difficulty level 3: When a match is found, the objects are collected but the empty boxes are left in play. FIG. 23, FIG. 24, FIG. 25 shows a snapshot halfway through the game. FIG. 31, FIG. 32, FIG. 33 shows a snapshot towards the end of the game. The number of empty boxes keeps increasing as the game progresses making this a very difficult level to play at. Chess players and students of memory training classes can play at this level.

FIG. 34 through FIG. 51 shows a setup where there is only one box per stack. 18 Boxes are placed on a flat surface in rows. Since all boxes are at the top of the stack, there is no lifting and dynamic relocation of boxes. This becomes a static game but the option to include some or all empty boxes exists. This is an easy level to play this game using boxes and memory objects included in this game.

Figure 52:
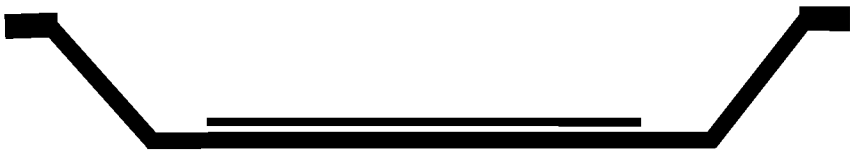
FIG. 52, FIG. 53: Shows an alternative setup. 18 stack-able flat boxes with no lids are used.
Figure 53:
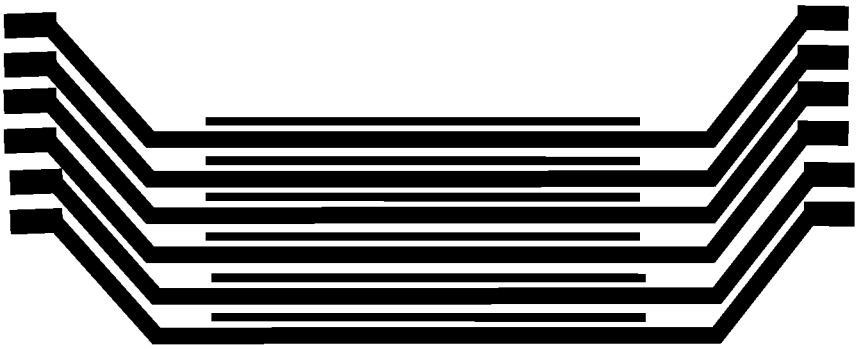

FIG. 52, FIG. 53 shows a simpler construction of this game. FIG. 52 shows one flat stack-able box with flat memory card placed face down in it. FIG. 53 shows a stack of 6 boxes with cards. This version includes additional 18 blank memory cards. To include an empty box in play, memory card is replaced with blank card. This is a less bulkier version but provides the same challenges.

Figure 54:
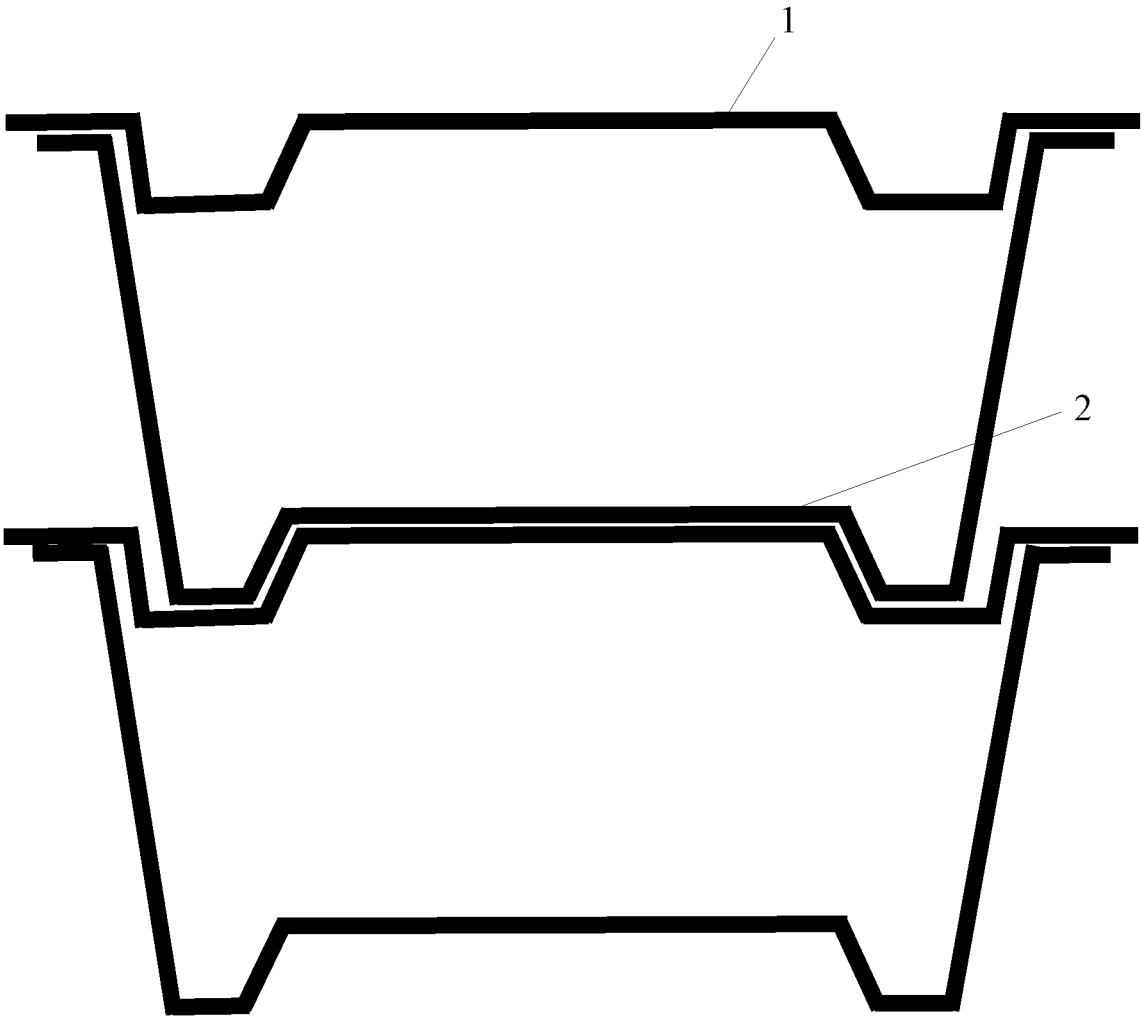
FIG. 54: Shows alternative box and lid shapes. Lid has an indent (1). Box has a matching indent (2). This makes stacking easier and stable. Memory object is placed on top of indent in the box; this improves visibility when lid is lifted.

FIG. 54 shows alternative shapes of box and lid. Lid has an indent (1) and box has a matching indent (2). The 3-D object is placed on top of the indent in the box. This improves the visibility of the object when the lid is removed.

Size, shape, and colors of the boxes can be varied. Using physical boxes and objects is one implementation of this game concept. A mobile/TV APP/Game using stacked box images, tapping a box causing boxes on top relocating and then revealing the object inside etc. can be developed using this invention.

The invention claimed is:

1. Method of playing a memory game by one or more players comprising the steps of:

providing a plurality of stack-able boxes and a plurality of lids, one lid for each box;

providing a plurality of matching pairs of memory cards or 3-D memory objects;

placing memory objects inside the boxes, wherein only one memory object being placed in each box and closing the boxes with the lids;

setting up the boxes in a plurality of stacks;

selecting and opening the lid of only the top box in any stack to reveal the one object placed inside the box;

if selecting boxes that are not at the top of the stack, lifting one or more boxes stacked on top of the selected boxes and placing the lifted boxes on top of another stack first, thereby exposing the selected boxes as top boxes, and then opening the lid of the selected top boxes;

lifting and placing of boxes on top of another stack to cause dynamic relocation of memory objects during play, physically and relative to other objects;

when two selected top boxes are opened and no match of memory objects is found, keeping the memory objects in their respective top boxes, replacing the lids to close the top boxes, and keeping the top boxes on top of their respective stacks;

when two selected top boxes are opened and a match of memory objects is found, collecting the matching memory objects and removing the empty boxes from the stacks;

repeating until all memory objects have been collected;

claiming a winner based on most memory objects collected.

2. The method of playing a memory game as in claim 1 where some or all of the empty boxes are left in play by replacing the lid after collecting matching memory objects, enabling inclusion of empty boxes in play where the empty boxes also dynamically relocate during play.

3. The method of playing a memory game as in claim 2 using a combination of steps listed below to enable playing the memory game at different difficulty levels:

setting up one box per stack setting up multiple boxes per stack allowing no empty boxes in play by removing empty boxes when a match is found allowing a few empty boxes in play by keeping empty boxes in play only when the first few matches are found allowing all empty boxes in play by keeping empty boxes in play for every match found.

* * * * *